United States Patent [19]

Chandler et al.

[11] Patent Number: 4,501,459

[45] Date of Patent: Feb. 26, 1985

[54] ELECTRICAL CONNECTOR

[75] Inventors: Curtis S. Chandler, Walkertown; Larry G. Novotny, Clemmons; Elvert S. Watts, Walkertown, all of N.C.

[73] Assignee: AMP Incorporated, Harrisburg, Pa.

[21] Appl. No.: 652,430

[22] Filed: Sep. 20, 1984

Related U.S. Application Data

[63] Continuation of Ser. No. 452,170, Dec. 22, 1982, abandoned.

[51] Int. Cl.[3] ..... H01R 25/00; H01R 13/54

[52] U.S. Cl. ..... 339/48; 339/49 B; 339/176 M; 339/222

[58] Field of Search ..... 339/19, 47 R, 48, 49 R, 339/49 B, 176 M, 222

[56] References Cited

U.S. PATENT DOCUMENTS

| | | | |
|---|---|---|---|
| 2,938,190 | 5/1960 | Krehbiel | 339/176 M |
| 3,126,241 | 3/1964 | Papalas | 339/222 |
| 3,157,448 | 11/1964 | Crimmins et al. | 339/176 M |
| 3,840,839 | 10/1974 | Smaczny et al. | 339/49 M |
| 3,860,318 | 1/1975 | Reavis, Jr. et al. | 339/99 R |
| 4,083,617 | 4/1978 | Wyatt | 339/47 R |
| 4,186,984 | 2/1980 | Reavis, Jr. et al. | 339/103 R |
| 4,224,486 | 9/1980 | Zimmerman, Jr. et al. | 339/184 M |
| 4,274,691 | 6/1981 | Abernathy et al. | 339/19 |
| 4,330,164 | 5/1982 | Pittman et al. | 339/49 R |

*Primary Examiner*—Gil Weidenfeld
*Assistant Examiner*—Paula Austin
*Attorney, Agent, or Firm*—Robert W. J. Usher; F. Brice Faller

[57] ABSTRACT

An electrical connector in which preselected terminals are shunted. Contact portions of the terminals are aligned with a shunt bar and are resiliently deformable from positions engaging the shunt bar in an unmated condition of the connector to positions spaced from the shunt bar in a mated condition of the connector by mating engagement with a complimentary connector. The shunt bar comprises a bridge portion from which contact lugs depend spaced asymmetrically along the bridge. Two shunt bars are located in tandem in back-to-back relation in a connector housing so that alternate contact tongues are aligned with respective contact lugs on respective shunt bars.

20 Claims, 8 Drawing Figures

ELECTRICAL CONNECTOR

This application is a continuation of application Ser. No. 452,170 filed Dec. 22, 1982, now abandoned.

The invention relates to an electrical connector, more particularly, to an electrical connector for use in the data communications industry.

There is requirement to protect the equipment from which an open data link-line extends to prevent spurious and potentially damaging electrical signals being conveyed along the link-line to the equipment, as a result of misconnection or electrical strays.

Accordingly, it has been proposed to shunt preselected terminals of an interface connector. A disadvantage of some prior proposals is that the shunting mechanism must be manually removed prior to mating of the connector to establish the data link.

In addition, it is important that the resulting construction is simple and reliable in operation and adapted for manufacture by mass production techniques.

According to one aspect of the invention, an electrical connector comprises an insulating housing having a front, mating face and a rear, wire connecting face, a plurality of terminals mounted in the housing with wire connecting portions at the wire connecting face and resilient contact portions at the mating face, electrical shunt means mounted in the housing aligned with preselected contact portions, the contact portions being resiliently deformable from positions engaging the shunt means in an unmated condition of the connector to positions spaced from the shunt means in a mated condition of the connector by mating engagement with a complementary connector. Any need for manipulation of the shunt means prior to mating is thereby avoided.

Preferably, the shunt means comprises a one-piece shunt bar having a bridge portion extending transversely of the contact portions which are formed as tongues, a plurality of mutually spaced contact lugs extending transversely of the bridge portion towards respective preselected contact tongues for engagement therewith in an unmated condition of the connector.

Accordingly, only, spaced preselected terminals need to be shunted, with intermediate terminals being bridged.

More specifically, the contact lugs are asymmetrically located along the bridge portion, and an additional, similar, shunt bar located in tandem relation to and orientated at 180° with the first mentioned shunt bar, the arrangement being such that alternate contact tongues are aligned with respective contact lugs on respective shunt bars.

Coding means may be provided on the shunt bars to ensure that receipt of the shunt bars in the housing in only one predetermined orientation or combination of orientations is possible.

Preferably, the contact tongues are reversely bent with rearwardly extending free ends aligned with the respective contact lugs.

As the tongues pivot about the axis of their fold line during mating engagement, the displacement of the ends away from the contact lugs of the shunt bar is advantageously greater than the displacement of their contact portions.

An example of a connector according to the invention, will now be described with reference to the accompanying drawings in which:

FIG. 5 is a cross-sectional view of the connector pair of FIG. 4 after mating;

Figure 1:
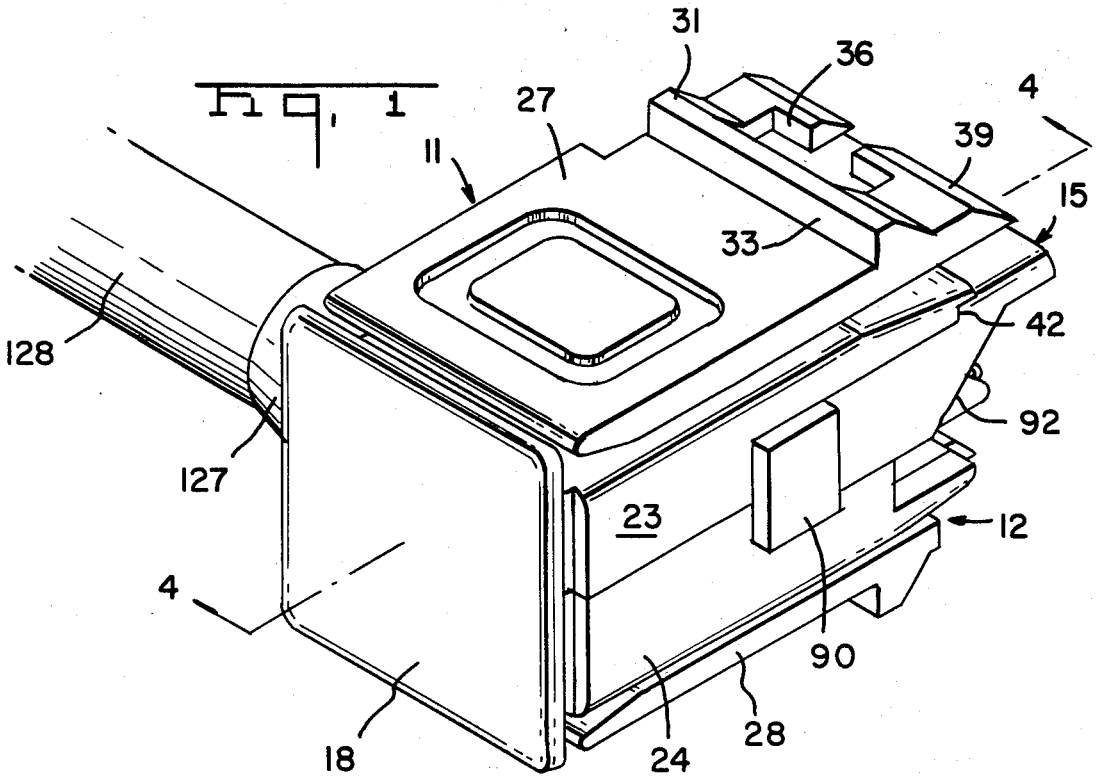
FIG. 1 is a perspective view of the connector with orthogonal cable lead out.
Figure 2:
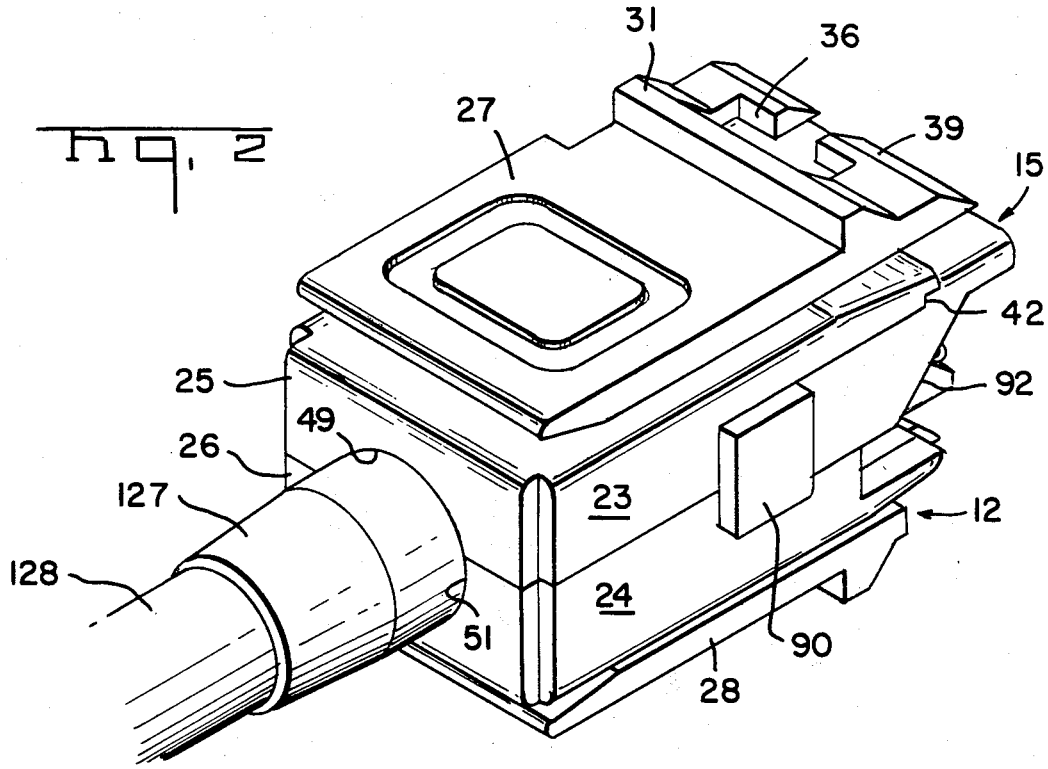
FIG. 2 is a perspective view of the connector with axial cable lead out.
Figure 3:
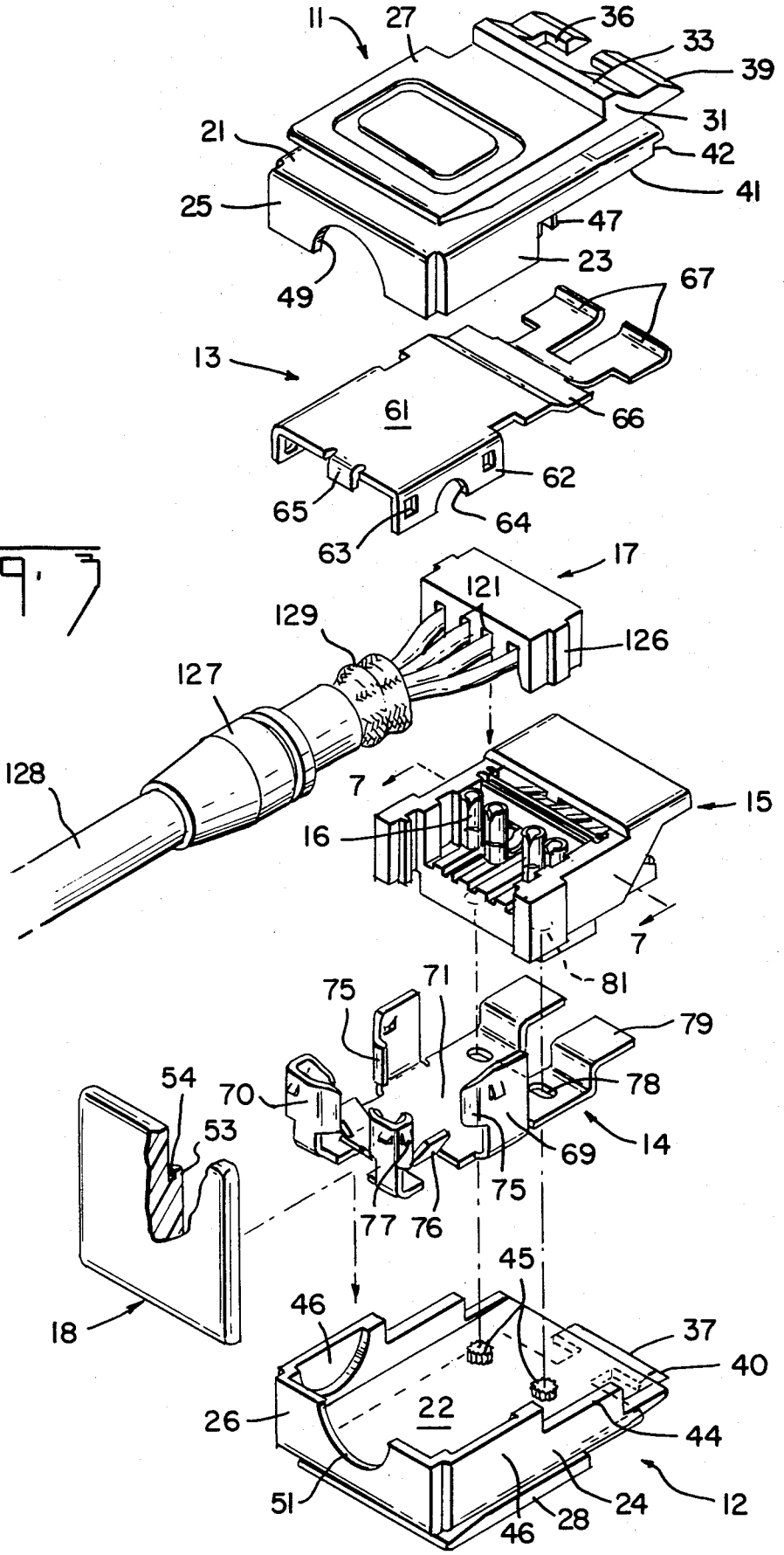
FIG. 3 is an exploded perspective view of the connector.
Figure 4:
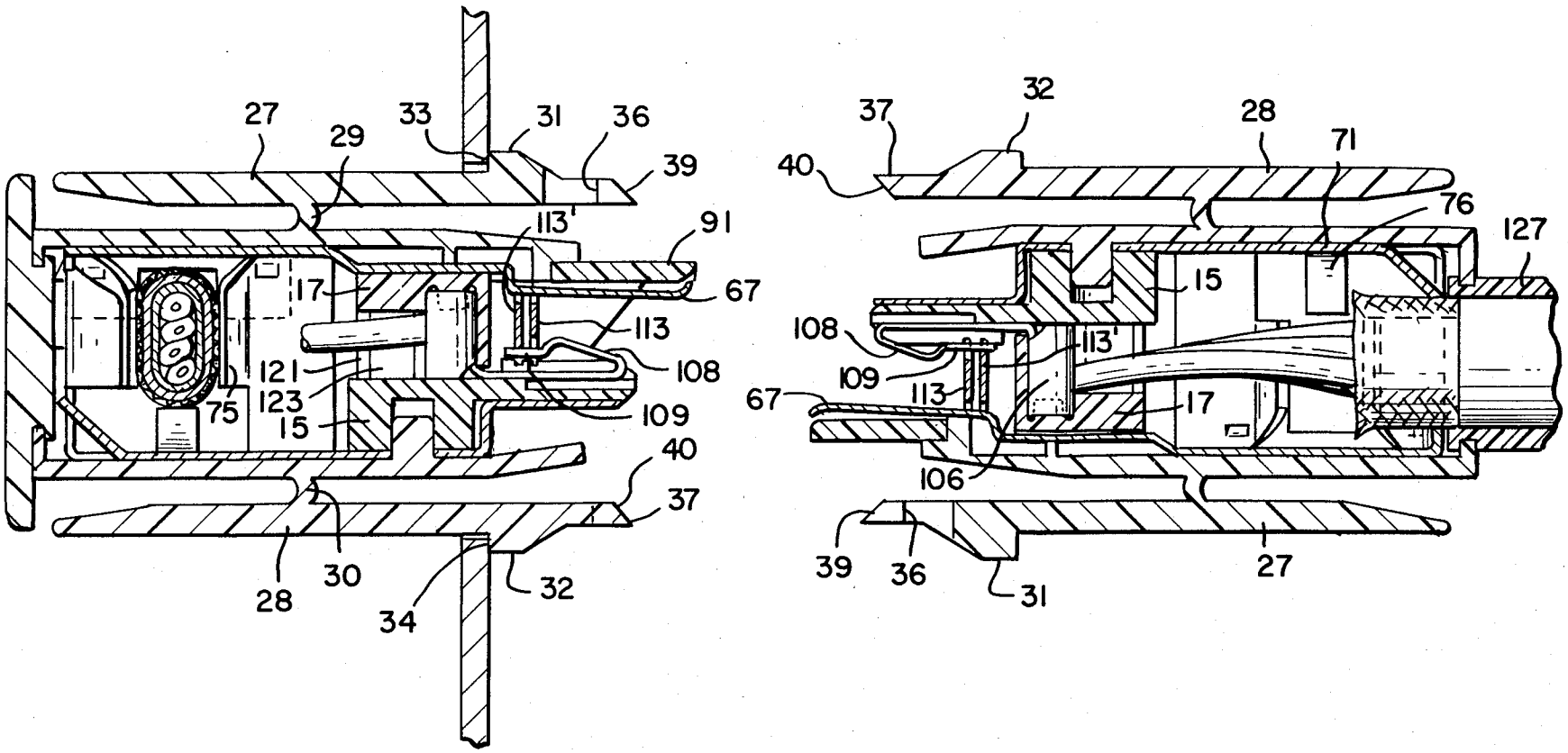
FIG. 4 is a cross-sectional view taken along line 4—4 of FIG. 1 of a pair of similar connectors aligned for mating.

Each connector is of identical hemaphroditic construction and as shown particularly in FIG. 3, comprise a bipartite cover 10 having upper and lower cover parts 11 and 12, respectively, of insulating plastics material, upper and lower cable clamping ground shields 13 and 14 respectively, a housing 15 for terminals 16 and a wire stuffer 17. A rear cap 18 is provided for attachment to the cover where axial cable lead out is not required.

Figure 6:
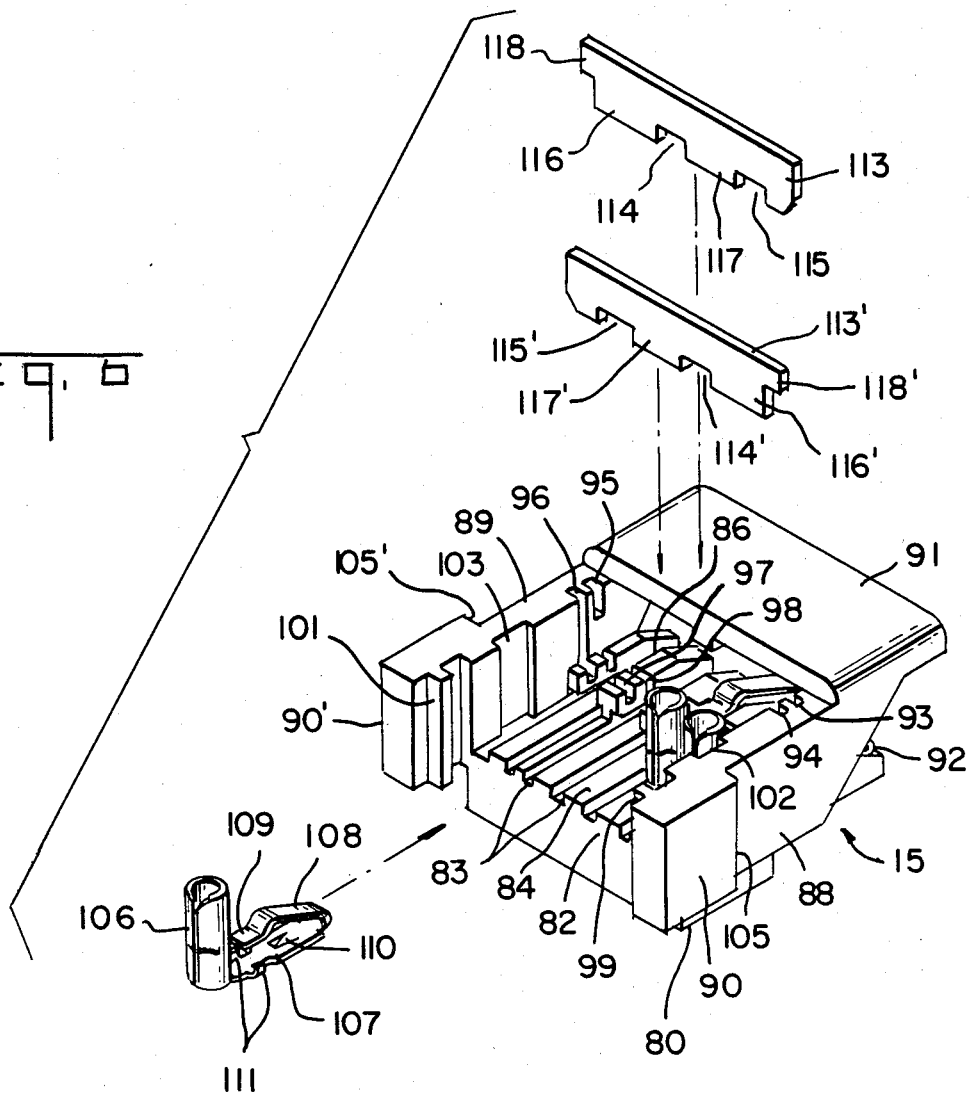
FIG. 6 is an exploded perspective view showing a terminal housing of the connector in greater detail.
Figure 7:
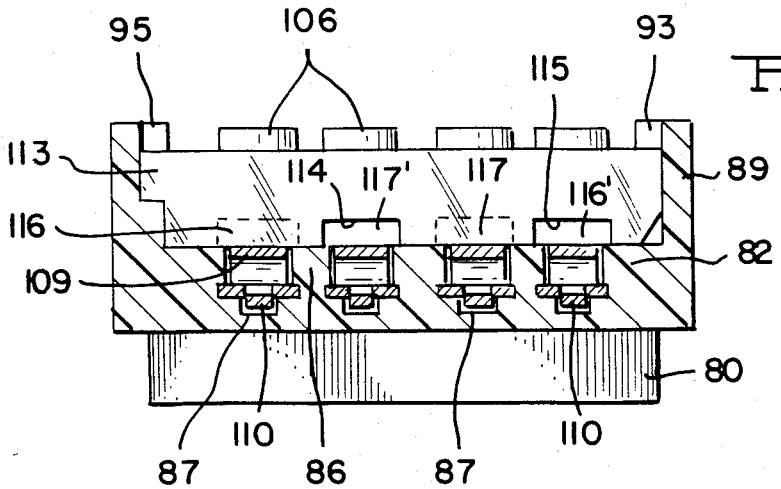
Figure 8:
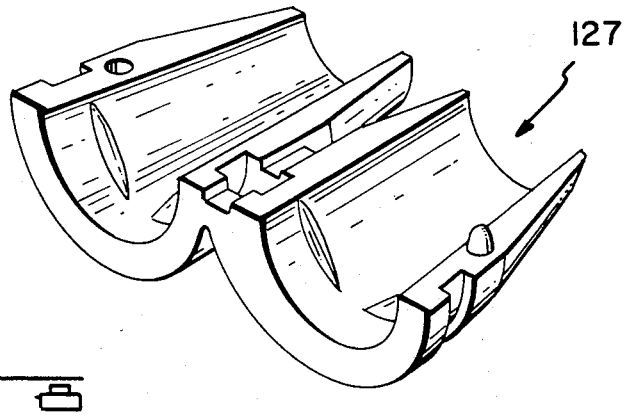

As shown particularly in FIGS. 3 and 6, the upper and lower cover parts 11 and 12 are each moulded in one piece of plastics material and comprise box-like constructions open at a front having respectively, base walls 21 and 22, pairs of opposite side walls 23 and 24 and rear walls 25 and 26. The covers are integrally formed with latching arms 27 and 28, respectively joined to the exterior of the side walls intermediate front and rear ends by web hinges 29 and 30 (as shown particularly in FIG. 5). Panel mounting ribs 31 and 32 defining rearwardly facing shoulders 33 and 34 and having canted, forwardly facing surfaces extend transversely across the arms adjacent front, mating ends which are formed with complementary latches comprising a T-slot 36 in one arm 27 for receiving a T-bar 37 in the other arm 28 having, respectively, canted lead-in surfaces 39 and 40. The side walls of the upper cover part 11 are rebated towards a front end to provide a terminal housing, receiving recess 41. A transverse sheild-locating rib 42 extends across the cover interior in parallel relation to a locating lip 42 stepped back from the front end.

The side walls 24 of the lower cover part 12 are also rebated towards a front end to provide a terminal housing receiving recess 44 and a pair of terminal housing locating studs 45 upstand from the base wall 22 adjacent the front end. Frangible portions 46 are provided in the side walls of both upper and lower cover parts to permit optional cable lead out directions. Cable receiving recesses 49 and 51 are provided in both rear walls to permit axial cable lead out. Cap 18 has a locating boss 53 with a peripheral groove 54 receiving the lips of the recesses 49 and 51 when axial lead out is not desired.

The upper shield 13 is stamped and formed from a single piece of sheet metal and comprises a base panel 61 from opposite sides of which depend flanges 62 having latching apertures 63 on each side of a cable receiving recess 64. A braid contacting tab 65 depends from a rear of the panel and a forwardly extending portion 66 is stepped and extends to a bifurcated contact portion having contact tabs with enlarged, upturned contact surfaces 67 at their front ends.

The lower shield 14 is also stamped and formed from one piece of sheet metal stock and comprises flanges 69, 70 that upstand from the opposite sides and the rear of a base panel 71, cable receiving apertures 73 and 74 being provided in such flange and being defined by inturned cable gripping lips 75 on respective opposite sides of each aperture. Braid connecting tabs 76 are pushed out of the base panel adjacent each aperture. Latching detents 77 are provided on the flanges for receipt in the latching apertures 63 where the upper shield is applied to the lower shield. A forwardly extending portion of the base panel is provided with a pair of stud receiving apertures 78 and the front of the base panel is bifurcated and stepped to provide contact surfaces 79 for establishing electrical connection with the contact surfaces 67 of the shield of a mating connector half, as shown in FIG. 5.

Figure 7:
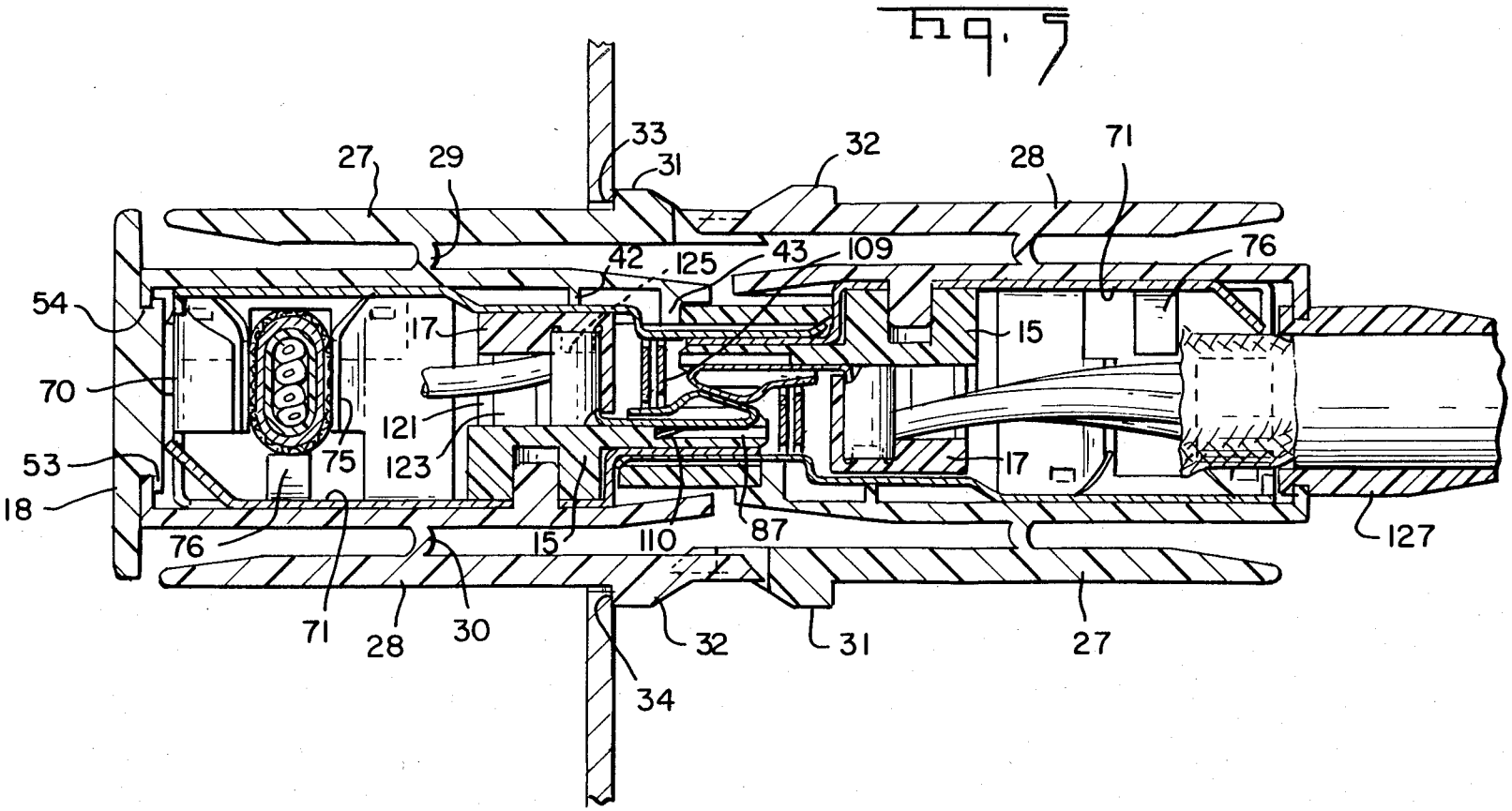
FIG. 7 is a cross-sectional view of the terminal housing taken along line 7—7 of FIG. 3; and, FIG. 8 is a perspective view of a bush for use with the connector.

Referring to FIGS. 6 and 7, the terminal housing 15 is moulded in one piece of plastics material and comprises a foot 80 supporting a terminal supporting platform 82 extending between forward, mating and rear, wire connecting faces of the housing. A series of parallel channels 83 extend forwardly across the terminal supporting platform 82 from the wire connecting face defining between them undercut terminal supporting ribs 84. Parallel locking grooves 87 extend rearwardly in alignment with the ribs from the front of the platform. Side walls 88 and 89 upstand from respective opposite side edges of the terminal supporting platform and are bridged at a front end by a hood 91. The side walls have canted leading edges 92 extending from locations adjacent the platform 82 to locations adjacent the front end of the hood. Pairs of aligned downwardly extending slots 93 and 95, 94 and 96 are formed in the side walls adjacent the hood, slots 94 and 95 being less extensive than aligned slots 93 and 96. Slots 97 and 98 are also formed across the ribs 84 in alignment with the respective slots in the side walls.

Adjacent the rear of the housing 15, longitudinally extending portions of the side walls are formed with vertical locating ribs 99, 101 and laterally extending side wall portions 90, 90' define forwardly facing mounting shoulders 105, 105' for abutment with the edges of a panel aperture. Vertically extending guide channels 102 and 103 are located in each side wall intermediate the ribs 99, 101 and the front of the terminal platform 82.

Each terminal 16 is stamped and formed from a single piece of sheet metal stock and comprises an upstanding slotted wire-receiving barrel 106 portion similar to that described in our U.S. Pat. No. 3,860,318 connected by a neck to a body portion 107 from a front end of which extends a reversely bent contact tongue 108 formed with a step 109 at a free end. A locking lance 110 is pushed out from the body portion 107 and locking ears 111 upstand from respective opposite edges of the body portion. The terminals are assembled with the housing 15 by insertion from the rear until their locking lances resile into the locking slots 87 when side edges of the body portion 107 will be located in the undercut areas under adjacent rear surfaces of the adjacent barrier walls 86, preventing further movement of the terminals in any direction. The contact tongues 108 will then be exposed at the mating face.

Identical shunting bars 113, 113' are stamped from single pieces of sheet metal with spaced apertures 114, 114' and 115, 115' defining between them contact lugs 116, 116' and 117, 117' extending from a bridge portion. Tabs 118, 118' extend from an end of each shunting bar. The shunting bars 113, 113' are located in respective aligned slots 93, 95, 97 and 94, 96, 98, mutually orientated at 180° so that tabs 118, 118' are received in the shorter slots 95, 94 respectively. It should be noted that, as shown in FIG. 7, the apertures 114, 115 of one shunting bar 113 are aligned with the contact lugs 116', 117' of the other bar 113' because of the asymmetric location of the apertures with the result that the contact lugs 116, 117 engage stepped ends 109 and shunt the first and third terminals and contact lugs 116', 117' engage stepped ends of the second or fourth terminals.

The stuffer 17 is moulded in one piece of stiffly flexible plastics material with a series of internal partition walls 123 defining wire receiving passageways extending between outer and inner wire gripping lip pairs 121 and 124 to a cylindrical barrel receiving portion having a cylindrical wire engaging projection 125 similar to that described in our U.S. Pat. No. 4,186,984. Vertical guiding ribs 126 extend on respective opposite ends.

In assembling the connector, the terminals 16 are inserted into the housing 15 as described above and the shunting bars 113, 113' are then inserted into the slots to shunt desired alternate terminals.

A hinged bush 127 is applied to a stripped shielded cable 128 in which shielding braid 129 has been reversely bent to extend rearwardly across a waisted supporting ferrule to clamp the braid and the individual insulated cable wires located in the stuffer passageways shown in FIG. 3. The stuffer is then urged downwardly guided by the cooperation of the ribs 126 and the grooves 102, 103 simultaneously into the wire receiving slots of the barrel portions.

The lower ground shield 14 may be heat staked or otherwise secured in the cover part 12 with the studs 45 registering within apertures 78. The terminal housing 15 terminating the wires is then assembled with the lower ground shield, the exposed braid portion being urged between the resilient lips 75 supported by the ferrule to establish electrical contact with the cable shield and ground. A tab 76 also engages the braid. The upper ground shield 13 is then applied to the housing 15 with the contact surfaces 67 inserted under the hood 91 on opposite sides of an axial rib and to the lower ground shield 14 so that the latching detents 77 are received in apertures 63 when the tab 55 will also engage the cable (with axial lead out) or the lips of a cable receiving recess 64.

The upper cover 11 is then applied to the terminal housing 15 and to the lower cover 12 (with the rear cap 18 omitted where axial lead out is desired) the locating ribs 99, 101 on the terminal housing cooperating with the grooved lugs 47.

On inserting the connector in a panel aperture, the shoulders 33 of the mounting ribs 31 snap behind the edges of the panel aperture on the other side of the panel preventing withdrawal while the shoulders 105, 105' abut the edges on the rear side preventing over insertion. An identical connector rotated through 180° is mated with the mounted connector by the T-bar being received in the T-slot providing a remarkably stable structure. On mating, the contact tongues 108 of the two connectors interengage depressing the stepped ends 109 out of engagement with the contact lugs 116, 116', 117, 117' of the shunting bars 113, 113' and the contact surfaces 79 and 67 of respective ground shields 13, 14 engage so that the ground shields substantially completely surround the exposed wires and the contacts irrespective of cable lead out direction providing braid-to-braid shielding.

The connector assembly is relatively inexpensive to manufacture in relation to its versatility and reliability of operation providing both reliable electrical characteristics and mechanical mating and mounting characteristics.

We claim:

1. A hermaphroditic electrical connector comprising an insulating terminal housing having a front, mating face and a rear, wire connecting face, a plurality of terminals mounted in the housing with wire connecting portions at the wire connecting face and resilient contact tongues at the mating face, electrical shunt means mounted in the housing aligned with preselected contact tongues, the shunt means comprising two one-piece shunt bars located in tandem relation, each having a bridge portion extending transversely of all the contact tongues and a pair of spaced contact lugs extending from each bridge portion toward respective preselected contact tongues, the contact tongues being resiliently deformable from positions engaging the shunt means in an unmated condition of the connector to positions spaced from the shunt means in a mated condition of the connector by mating engagement with a complementary hermaphroditic connector.

2. An electrical connector according to claim 1 in which the contact tongues are reversely bent with rearwardly extending free ends aligned with the respective contact lugs.

3. An electrical connector as in claim 1 wherein the contact lugs of each shunt bar extend toward alternate contact tongues.

4. An electrical connector as in claim 1 wherein the shunt bars are substantially identical, each shunt bar being oriented 180° from the other.

5. An electrical connector according to claim 1 wherein the contact lugs on each shunt bar are asymmetrically located along the bridge portion.

6. An electrical connector according to claim 5 in which the bridge portions have coding lugs at their ends and the housing is formed with axially spaced coding slots on respective opposite side walls for receiving the respective lugs.

7. A hermaphroditic electrical connector for mating with a complementary hermaphroditic electrical connector comprising:

an insulating terminal housing having a front, mating face, a rear wire connecting face, and a terminal supporting platform extending between said faces, a plurality of terminals mounted in the housing with contact portions toward the mating face and wire connecting portions toward the wire connecting face, each contact portion being reversely bent at the mating face to form a resilient contact tongue spaced from said platform and having a free end remote from the mating face, each contact tongue being matable against the contact tongue of the complementary connector to urge the contact tongues in each connector toward respective platforms, electrical shunt means fixedly mounted in said housing transversely of all said contact portions and disposed adjacent to said contact tongues toward the free ends thereof, said shunt means engaging preselected contact tongues when said connector is in an unmated condition, said shunt means being spaced from said preselected contact portions when said connector is in a mated condition, conductive electrical shield means assembled to said housing, said shield means having contact portions toward the mating face, said contact portions being matable with complementary contact portions of the electrical shield means in a complementary connector, and insulating cover means assembled to said housing externally of said shield means.

8. An electrical connector as in claim 7 wherein said preselected contact tongues are alternate contact tongues.

9. An electrical connector as in claim 7 wherein all of said contact tongues are engaged by said shunt means when said connector is in an unmated condition.

10. An electrical connector as in claim 7 wherein the free end of each contact tongue is formed toward the platform to form a step which engages the electrical shunt means.

11. An electrical connector as in claim 7 wherein each said wire connecting portion comprises a slotted wire receiving barrel portion upstanding from said platform, said connector further comprising a wire stuffer profiled to insert wires into respective barrels, said shield means being assembled to said housing externally of said wire stuffer.

12. An electrical connector as in claim 7 wherein said shunt means comprises a first one-piece shunt bar having a bridge portion extending transversely of the tongues, said bar having a pair of spaced contact lugs extending toward a first pair of alternate contact tongues, said lugs being in contact with said alternate contact tongues when said connector is in an unmated condition.

13. An electrical connector as in claim 12 wherein said housing comprises a pair of opposed sidewalls upstanding from opposite side edges of said platform, said sidewalls having a pair of respective opposed slots therein which receive said shunt bar.

14. An electrical connector as in claim 12 wherein said shunt means comprises a second similar shunt bar located in tandem relation to the first shunt bar, said contact lugs on said second shunt bar being in contact with a second pair of alternate contact tongues.

15. An electrical connector as in claim 14 wherein said housing comprises a pair of opposed sidewalls upstanding from opposite side edges of said platform, said sidewalls having two pairs of respective opposed slots therein which receive said shunt bars.

16. An electrical connector as in claim 15 wherein the bridge portions have coding lugs at their ends and each pair of opposed slots is coded to receive the respective shunt bar oriented at 180° from the other shunt bar.

17. An electrical connector of the type comprising an insulating housing having a front mating face for mating with a complementary connector and a plurality of terminals mounted thereon, each terminal having a resilient contact tongue extending from proximate the mating face to a free end remote from the mating face, and electrical shunt means fixed in said housing aligned with the free ends of preselected contact tongues, the contact tongues being resiliently deformable from positions engaging the shunt means in an unmated condition of the connector to positions spaced from the shunt means in a mated position of the connector by mating engagement with the complementary connector, characterized in that, the connector is a shielded connector for mating with a complementary hermaphroditic connector, the housing having a rear wire connecting face opposite said front mating face and a terminal supporting platform extending between said faces, each contact tongue being matable against the contact tongue of the complementary connector whereby the contact tongues in each connector are urged toward respective platforms, said shunt means comprising two one-piece shunt bars located in tandem relation, each having a bridge portion extending transversely of all the contact tongues, and disposed above the free ends thereof, and a pair of spaced contact lugs extending from each bridge portion toward respective preselected contact tongues, each shunt bar engaging a pair of preselected contact tongues when said connector is in an unmated condition, each of said shunt bars being spaced from said preselected contact portions when said connector is in a mated condition.

18. The electrical connector of claim 17 wherein the contact lugs of each shunt bar extend toward alternate contact tongues.

19. The electrical connector according to claim 17 wherein the contact lugs on each shunt bar are asymmetrically located along the bridge portion.

20. An electrical connector as in claim 19 wherein the shunt bars are substantially identical, each shunt bar being oriented 180° from the other.

* * * * *